United States Patent [19]

Andress et al.

[11] Patent Number: 4,971,598

[45] Date of Patent: Nov. 20, 1990

[54] REACTION PRODUCTS OF ALKENYL SUCCINIMIDES WITH ETHYLENEDIAMINE CARBOXY ACIDS AS FUEL DETERGENTS

[75] Inventors: Harry J. Andress, Wenonah; Henry H. Ashjian, E. Brunswick, both of N.J.; Frederick J. Hills, Clifton, Va.

[73] Assignee: Mobil Oil Corporation, Fairfax, Va.

[21] Appl. No.: 497,368

[22] Filed: Mar. 22, 1990

Related U.S. Application Data

[63] Continuation-in-part of Ser. No. 238,679, Aug. 30, 1988, abandoned.

[51] Int. Cl.[5] ..... C10L 1/22

[52] U.S. Cl. ..... 44/57; 44/71; 548/546; 548/547

[58] Field of Search ..... 44/71, 57; 548/546, 548/547

[56] References Cited

U.S. PATENT DOCUMENTS

| | | | |
|---|---|---|---|
| 3,367,943 | 2/1968 | Miller et al. | 260/326.3 |
| 3,373,111 | 3/1968 | Suer et al. | 252/51.5 |
| 3,374,174 | 3/1968 | Suer et al. | 252/51.5 |
| 3,547,867 | 12/1970 | Andress et al. | 260/97.5 |
| 4,177,192 | 12/1979 | Heiba et al. | 260/326.5 |
| 4,242,101 | 12/1980 | Vogel et al. | 44/58 |
| 4,509,951 | 4/1985 | Knapp | 44/53 |

FOREIGN PATENT DOCUMENTS

| | | |
|---|---|---|
| 4141762 | 5/1979 | Japan . |
| 4141763 | 5/1979 | Japan . |

*Primary Examiner*—Olik Chaudhuri
*Assistant Examiner*—Ellen McAvoy
*Attorney, Agent, or Firm*—A. J. McKillop; C. J. Speciale; M. J. Mlotkowski

[57] ABSTRACT

An additive for fuel compositions. The additive comprises the reaction product of an alkenyl succinimide selected from the group consisting of mono-succinimides, bis-succinimides, and mixtures thereof, with iminodiacetic acid or an ethylenediamine carboxy acid. The reaction product finds particular utility as a fuel detergent.

15 Claims, No Drawings

REACTION PRODUCTS OF ALKENYL SUCCINIMIDES WITH ETHYLENEDIAMINE CARBOXY ACIDS AS FUEL DETERGENTS

RELATED APPLICATIONS

This application is a continuation-in-part of copending application Ser. No. 238,679, filed on Aug. 30, 1988 now abandoned.

NATURE OF THE INVENTION

This invention relates to the reaction products of alkenyl succinimides with ethylenediamine carboxy acids to provide products having excellent diesel fuel injector detergency.

DESCRIPTION OF THE PRIOR ART

U.S. Pat. No. 4,177,192 discloses that hydrocarbyl succinimides of aminoaryl sulfonic acid salts are effective multifunctional additives for lubricating oils and other organic fluids used for hydraulic purposes. The succinimide derivatives of ammonium or metal salts of aminoaryl sulfonic acid are prepared by reacting alkenylsuccinic acid anhydride or ester with the said metal or ammonium salt.

U.S. Pat. No. 4,242,101 discloses imides or amide-imides of nitrilotriacetic acid or of ethylenediaminetetraacetic acid to be useful additives for lubricating oils.

SUMMARY OF THE INVENTION

This invention in one aspect comprises the reaction product obtained by reacting ethylenediamine carboxy acids with alkenyl succinimides where the alkenyl substituent is derived from a mixture of $C_{16}$ to $C_{28}$ olefins. The resulting reaction product provides excellent detergency when added to diesel fuel. In another aspect this invention comprises the diesel fuel composition resulting from mixing the additive of this invention with diesel fuel.

DESCRIPTION OF SPECIFIC EMBODIMENTS

As noted above one aspect of this invention comprises the additive material resulting from the reaction of alkenyl succinimides where the alkenyl group, $R^1$ shown below, is derived from a mixture of $C_{12}$ to $C_{50}$ olefins, preferably a mixture of $C_{12}$ to $C_{30}$ olefins, particularly alpha olefins, reacted with ethylenediamine carboxy acids. The alkenyl succinimides are materials well known particularly to those skilled in the art and can be prepared by reacting a polyalkylenesuccinic acid or anhydride, wherein the polyalkylene is derived from a $C_2$, $C_3$, or $C_4$ olefin, or mixtures thereof, with a polyalkylene polyamine of the formula:

$$NH_2—(RNH)_n—R—NH_2$$

in which R is an alkylene radical having from 1 to 5 carbon atoms and "n" is from 0 to 10.

The polyalkylenesuccinic anhydride can be made in accordance with a prior art process involving the thermal condensation of a polyalkylene or polyalkylene mixture with maleic anhydride. This is conveniently carried out at from about 150° C. to about 250° C., preferably about 175° C. to 225° C. Particularly preferred is the succinic acid or anhydride derived from a polyalkylene such as polyisobutylene.

Suitable polyamines includes methylene diamine, ethylene diamine, diethylene triamine, dipropylene triamine, triethylene tetramine, tetraethylene pentamine, pentamethylene hexamine, hexaethylene heptamine, undecaethylene dodecamine, and the like.

One series of reactions, showing one possible product, is as follows:

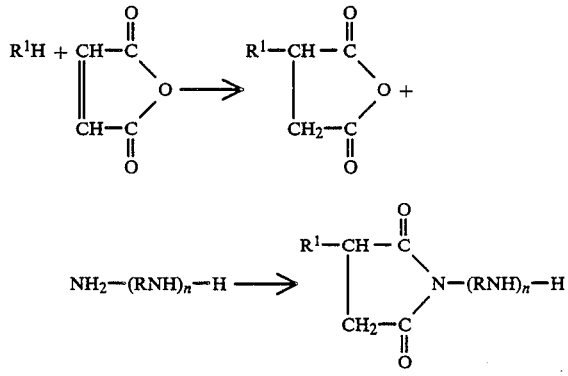

In the formula above, $R^1$ is polyalkylene ranging from 300 to 1200 molecular weight, R is an alkylene containing 1 to 5 carbon atoms, and 'n' is from 1 to 10.

The reaction mixture may contain from 1 mole of the anhydride per mole of the amine, or it may have an amount of anhydride equivalent to the total NH functions in the amine, i.e., up to 14 moles of anhydride per mole of amine.

Although a mono-succinimide reaction product is shown above, it is to be understood that bis-succinimide reaction products and mixtures of mono-succinimdes and bis-succinimides have utility in the practice of the present invention. As those skilled in the art would recognize, such a bis-succinimide reaction product would have the following structure:

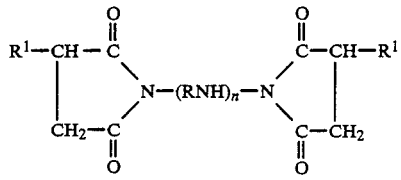

wherein, once again, $R^1$ is polyalkylene ranging from 300 to 1200 molecular weight, R is an alkylene containing 1 to 5 carbon atoms, and "n" is from 1 to 10.

The ethylenediamine carboxy acids have a structural formula as follows:

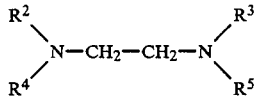

where $R^2$, $R^3$, $R^4$, and $R^5$ are each hydrogen or a carboxyl group,

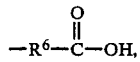

where $R^6$ is 0 to 3 carbon atoms in number. A preferred acid is ethylenediaminetetraacetic acid although other acids such as ethylenediaminetriacetic acid, and ethylenediaminediacetic acid can also be used. Additionally, while not encompassed by the structural formula given above for the useful ethylenediamine carboxy acids, it has also been found that iminodiacetic acid can also be used and is to be considered within the scope of the present invention.

The reaction, preferably is carried out by the direct reaction of the two reactants at temperatures from 100° C. to 250° C. for periods of between 1 and 6 hours at pressures from atmospheric up to about 100 psig. The preferred ratios between the reactants is between 1 and 30 moles of alkenyl succinimide to 1 mole of the ethylenediamine carboxy acid. Particularly preferred are reactant ratios of between 1 and 10 moles of alkenyl succinimide to 1 mole of ethylenediamine carboxy acid. After the reaction is completed, the product is vacuum topped or nitrogen sparged and is then filtered to yield the desired reaction product. As noted previously another aspect of this invention is the diesel fuel product formed by mixing the above described additive with diesel fuel. Ordinarily effective amounts of additive to be added to the diesel fuel will be in the range of 10 to 300 pounds of additive per 1000 barrels of diesel fuel. It will also be understood that the resulting fuel composition can contain other additive materials for other purposes in the composition. Other additives can include detergents, antioxidants, stabilizers, and the like.

This invention is illustrated by the following nonlimiting examples in which all parts are by weight unless otherwise noted.

EXAMPLE 1

A mixture of 600 grams (2.0 mols) of an olefin mixture comprising

| | Percent by Weight |
|---|---|
| Olefin Chain length | |
| $C_{16}$ | 2 Max. |
| $C_{18}$ | 5–15 |
| $C_{20}$ | 42–50 |
| $C_{22}$ | 20–28 |
| $C_{24}$ | 6–12 |
| $C_{26}$ | 1–3 |
| $C_{28}$ | 2 Max. |
| Alcohol | 10 Max. |
| Paraffin | 5 Max. |
| Olefin Types by NMR | |
| Vinly | 28–44 |
| Branched | 30–50 |
| Internal | 26–42 |

and 198 grams (2.0 mols) of maleic anhydride was stirred at about 200°–210° C. for seven hours and at about 235°–240° C. for three hours to form the alkenylsuccinic anhydride. A mixture of 170 grams (0.9 mol) of tetraethylene pentamine and 500 ml. of toluene diluent was added to the alkenyl succinic anhydride at about 75° C. The mixture was gradually refluxed to about 225° C. and held until the evolution of water ceased. The final product was obtained by topping under reduced pressure.

EXAMPLE 2

A mixture of 300 grams of the alkenyl succinimide of Example 1 and 41 grams of ethylenediaminetetraacetic acid was stirred to a temperature of about 220° C. over a period of six hours using a stream of nitrogen to aid in the removal of water. The final product was obtained by filtration.

EXAMPLE 3

A mixture of 289 grams (1.0 mol) tetraethylene pentamine and 712 grams (2.5 mols) tall oil fatty acids was stirred to about 175° C. over a three hour period evolving 45.0 grams (2.5 mols) of water. Subsequently, 106.0 grams (0.25 mol) of $C_{18}$–$C_{26}$ alkenyl succinic anhydride was added and the mixture stirred for an hour at 175° C. under reduced pressure to aid in the removal of water. The final product was obtained by filtration.

EXAMPLE 4

A mixture of 350 grams of the product of Example 3 and 35 grams of ethylenediaminetetraacetic acid was stirred to about 175° C. over a six hour period using a stream of nitrogen to aid in the removal of water. The final product was obtained by filtration.

EXAMPLE 5

A mixture of 420 grams (1.0 mol) of a polybutene and 98 grams (1.0 mol) of maleic anhydride was stirred at a temperature of about 200° C. for four hours and then at a temperature of about 225° C. for three hours to form the alkenylsuccinic anhydride.

A mixture of the above polybutenylsuccinic anhydride and 94.5 grams (0.5 mol) of tetraethylenepentamine was gradually heated with stirring to a temperature of about 225° C. and held at that temperature until the evolution of water ceased. The final product was obtained by topping under reduced pressure.

EXAMPLE 6

A mixture of 300 grams of the polybutenylbissuccinimide produced in Example 5 and 1.7 grams of ethylene diamine tetraacetic acid was stirred to about 200° C. over a six hour period using a stream of nitrogen to aid in the removal of water. The final product was obtained by filtration.

DIESEL FUEL INJECTOR TEST

Evaluation tests to determine the effect of additives on nozzle coking in indirect injection diesel engines were run in a 1979 Mercedes 300 SD car equipped with a five cylinder, 3.liter, turbo-charged diesel engine. The car was operated on a computer-controlled allweather chassis dynamometer over a city-suburban cycle for 3700 miles. The car was operated for sixteen hours per day at an average speed of 22 mph, followed by eight hours of no operation. Using a specially modified injection pump, both base fuel and additive fuel were run in the engine at the same time. Two cylinders were operated on base fuel and three cylinders on additive-treated fuel.

At the end of the test, the injectors were carefully removed from the engine and evaluated with an air flow tester described in ISO standard 4010-1977. Air flow was measured at various needle lifts and compared to clean flow. Literature states that the most significant air flow for the Bosch injectors used in the Mercedes engine is at 0.1 mm needle lift.

TABLE 1

Additives were blended in a commercial diesel fuel of about 42 cetane number having a boiling range of about 350–750° F.

| Additive | Conc. lbs./ 1000 Bbls. | Air Flow at 0.1 mm cc/min. | Percent Improvement |
|---|---|---|---|
| Base Fuel | 0 | 10 | 0 |

TABLE 1-continued

Additives were blended in a commercial diesel fuel of about 42 cetane number having a boiling range of about 350–750° F.

| Additive | Conc. lbs./ 1000 Bbls. | Air Flow at 0.1 mm cc/min. | Percent Improvement |
|---|---|---|---|
| Base Fuel + Ex. 2 | 30 | 57 | 570 |
| Base Fuel + Ex. 4 | 30 | 60 | 600 |
| Base Fuel + Ex. 6 | 30 | 71 | 710 |

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. An additive for diesel fuel compositions comprising the reaction product of an alkenyl succinimide selected from the group consisting of mono-succinimides of the structural formula:

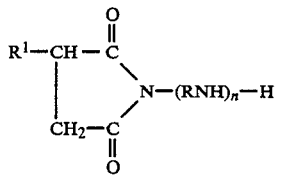

wherein the number of carbon atoms in $R^1$ is from between about 12 to about 50, R is an alkylene containing 1 to 5 carbon atoms and n is from 1 to 10, bis-succinimides of the structural formula:

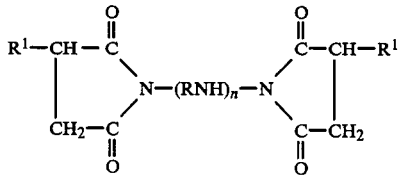

wherein the number of carbon atoms in $R^1$ is from between about 12 to about 50, R is an alkylene containing 1 to 5 carbon atoms and n is from 1 to 10, and mixtures thereof, with iminodiacetic acid or an ethylenediamine carboxylic acid having the structural formula:

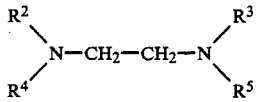

wherein $R^2$, $R^3$, $R^4$, $R^5$, are each a a

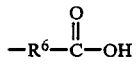

group where $R^6$ is 0 to 3 carbon atoms in number, said reaction product formed by reacting between about 1 mole and about 30 moles of said alkenyl succinimide with 1 mole of said ethylene diamine carboxylic acid or imino-diacetic acid at a temperature of between about 100° C. and about 250° C. and at a pressure from about atmospheric to about 100 psig.

2. The reaction product of claim 1 wherein $R^1$ is derived from a mixture of alpha olefins.

3. The reaction product of claim 1 wherein $R^1$ is derived from polybutenyl olefins.

4. The reaction product of claim 1 wherein the ethylenediamine carboxylic acid is ethylenediaminetetraacetic acid and the ratio of alkenyl succinimide reactant to ethylenediaminetetraacetic acid is between about 1 to about 10 moles of alkenyl succinimide reactant to one mole of ethylenediaminetetraacetic acid.

5. An additive for diesel fuel compositions comprising the reaction product of an alkenyl succinimide selected from the group consisting of mono-succinimides of the structural formula:

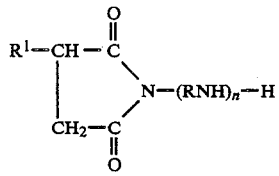

wherein the number of carbon atoms in $R^1$ is from between about 12 to about 50, R is an alkylene containing 1 to 5 carbon atoms and n is from 1 to 10, bis-succinimides of the structural formula:

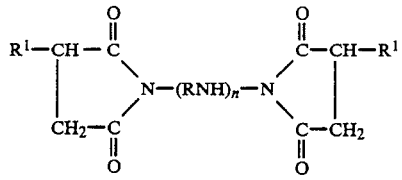

wherein the number of carbon atoms in $R^1$ is from between about 12 to about 50, R is an alkylene containing 1 to 5 carbon atoms and n is from 1 to 10, and mixtures thereof, with an ethylenediamine carboxylic acid selected from the group consisting of ethylenediaminetriacetic acid and ethylenediaminetetraacetic acid, said reaction product formed by reacting between about 1 mole and about 30 moles of said alkenyl succinimide with 1 mole of said ethylenediamine carboxylic acid at a temperature of between about 100° C. and about 250° C. and at a pressure from about atmospheric to about 100 psig.

6. The reaction product of claim 1 wherein the duration of the reaction is between about 1 and 6 hours.

7. The diesel fuel additive of claim 5 wherein $R^1$ is derived from a mixture of alpha olefins.

8. The diesel fuel additive of claim 5 wherein $R^1$ is derived from polybutenyl olefins.

9. The diesel fuel additive of claim 5 wherein the ethylenediamine carboxylic acid is ethylenediaminetetraacetic acid.

10. The diesel fuel additive of claim 5 wherein the duration of the reaction is between about 1 and 6 hours.

11. A diesel fuel composition comprising a diesel fuel and between about 10 and about 300 pounds per 1000 barrels of diesel fuel of an additive for diesel fuel compositions comprising the reaction product of an alkenyl succinimide selected from the group consisting of mono-succinimides of the structural formula:

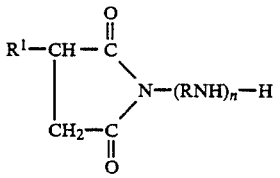

wherein the number of carbon atoms in $R^1$ is from between about 12 to about 50, R is an alkylene containing 1 to 5 carbon atoms and n is from 1 to 10, bis-succinimides of the structural formula:

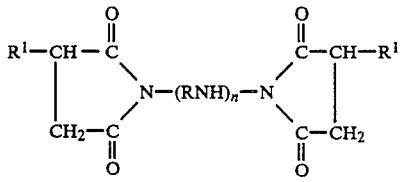

wherein the number of carbon atoms in $R^1$ is from between about 12 to about 50, R is an alkylene containing 1 to 5 carbon atoms and n is from 1 to 10, with an ethylenediamine carboxylic acid selected from the group consisting of ethylenediaminetriacetic acid and ethylenediaminetetraacetic acid, said product formed by reacting between about 1 mole and about 30 moles of said alkenyl succinimide with 1 mole of said ethylenediamine carboxylic acid at a temperature of between about 100° C. and about 250° C. and at a pressure from about atmospheric to about 100 psig.

12. The diesel fuel composition of claim 11 wherein $R^1$ is derived from a mixture of alpha olefins.

13. The diesel fuel composition of claim 11 wherein $R^1$ is derived from polybutenyl olefins.

14. The diesel fuel composition of claim 11 wherein the ethylenediamine carboxylic acid is ethylenediaminetetraacetic acid.

15. The diesel fuel composition of claim 11 wherein the duration of the reaction is between about 1 and 6 hours.

* * * * *